US007022002B2

(12) United States Patent
Lampka et al.

(10) Patent No.: US 7,022,002 B2
(45) Date of Patent: Apr. 4, 2006

(54) MODULAR COUNTERWEIGHT APPARATUS FOR AN ORBITAL ABRADING MACHINE

(75) Inventors: Mark Lampka, East Amherst, NY (US); Bryan D. Decker, Clarence, NY (US)

(73) Assignee: Dynabrade, Inc., Clarence, NY (US)

( * ) Notice: Subject to any disclaimer, the term of this patent is extended or adjusted under 35 U.S.C. 154(b) by 128 days.

(21) Appl. No.: 10/792,314

(22) Filed: Mar. 3, 2004

(65) Prior Publication Data

US 2005/0197052 A1 Sep. 8, 2005

(51) Int. Cl.
*B24B 23/00* (2006.01)

(52) U.S. Cl. ..... 451/344; 451/357

(58) Field of Classification Search ..... 457/344, 457/353, 357, 359

See application file for complete search history.

(56) References Cited

U.S. PATENT DOCUMENTS

| | | | | |
|---|---|---|---|---|
| 2,751,725 | A | 6/1956 | Champayne | |
| 3,205,622 | A | 9/1965 | Leveque | |
| 3,287,859 | A | 11/1966 | Leveque | |
| 3,345,784 | A | 10/1967 | Stelljes et al. | |
| 4,467,565 | A * | 8/1984 | Wallace et al. | 451/357 |
| 4,610,111 | A | 9/1986 | Cox | |
| 4,660,329 | A * | 4/1987 | Hutchins | 451/357 |
| 4,729,194 | A | 3/1988 | Maier et al. | |
| 4,744,177 | A | 5/1988 | Braun et al. | |
| 4,791,694 | A | 12/1988 | Itaya et al. | |
| 4,854,085 | A | 8/1989 | Huber | |
| 4,924,636 | A * | 5/1990 | Hoffman | 451/357 |
| 5,040,340 | A | 8/1991 | Bischof et al. | |
| 5,392,568 | A | 2/1995 | Howard, Jr. et al. | |
| 5,425,666 | A | 6/1995 | Frank et al. | |
| 5,496,207 | A | 3/1996 | Hornung et al. | |
| 5,823,862 | A | 10/1998 | Heidelberger | |
| 5,888,128 | A | 3/1999 | Lamprecht et al. | |
| 6,007,412 | A * | 12/1999 | Hutchins | 451/295 |
| 6,206,771 | B1 | 3/2001 | Lehman | |

(Continued)

FOREIGN PATENT DOCUMENTS

| | | |
|---|---|---|
| DE | 3727487 | 3/1989 |

OTHER PUBLICATIONS

Mable, Hamilton H. and Ocvirk, Fred W. "Mechanisms and Dynamics of Machinery." John Wiley & Sons, New York, Third Edition, pp. 490-497.

*Primary Examiner*—Eileen P. Morgan
(74) *Attorney, Agent, or Firm*—Simpson & Simpson, PLLC

(57) ABSTRACT

A head portion for counterbalancing a random orbital machine including a first element adapted for connection to a drive means for the machine and to an abrasive pad assembly. The drive means is rotatable about a first axis of rotation and the abrasive pad assembly is rotatable about a second axis of rotation that is parallel to the first axis of rotation and lying within a plane common with the first axis. The head portion also includes a second element detachably connected to the first element. The first and second elements are configured to at least substantially counterbalance portions of the abrasive pad assembly not disposed concentrically of the first axis of rotation and forces to which the abrasive pad assembly is exposed during use as a result of the abrasive pad assembly engaging with a work surface.

13 Claims, 7 Drawing Sheets

U.S. PATENT DOCUMENTS

| | | | |
|---|---|---|---|
| 6,244,933 | B1 | 6/2001 | Morkvenas |
| 6,413,157 | B1 | 7/2002 | Marton |
| 6,475,066 | B1 | 11/2002 | Panagian |
| 6,485,360 | B1 | 11/2002 | Hutchins |
| 2002/0031922 | A1 | 3/2002 | Clower et al. |
| 2003/0017795 | A1 | 1/2003 | Walker |
| 2003/0032381 | A1 | 2/2003 | Dutterer et al. |
| 2003/0092369 | A1 | 5/2003 | Marton |

* cited by examiner

MODULAR COUNTERWEIGHT APPARATUS FOR AN ORBITAL ABRADING MACHINE

FIELD OF THE INVENTION

The present invention relates generally to an apparatus for balancing an orbital abrading machine. More particularly, the present invention apparatus relates to balancing an orbital abrading machine while the machine is operating under load. The present invention apparatus includes a counterweight element that can be readily detached and replaced to enable the balancing of the machine under different loading conditions.

BACKGROUND OF THE INVENTION

Orbital abrading machines are well-known and generally comprise a portable, manually manipulatable housing, a motor supported by the housing and having or being coupled to a drive shaft driven for rotation about a first axis, and an assembly for mounting a pad for abrading a work surface for orbital movement about the first axis. In a random orbital abrading machine, the assembly serves to additionally mount the pad for free rotational movement about a second axis, which is disposed parallel to the first axis.

The assembly typically includes a head portion coupled for driven rotation with the drive shaft about the first axis and defining a mounting recess having an axis arranged coincident with the second axis, a bearing supported within the mounting recess, and means for connecting the pad to the bearing for rotation about the second axis.

An orbital machine having an element, such as pad, driven for movement about an orbital path of travel is by nature unbalanced and tends to produce vibrations, which may be felt by the hands of an operator of the machine. With a view towards maintaining such vibrations at acceptable levels, it has been common practice to employ a counterbalance system of the type described in Chapter 12 Mechanisms and Dynamics of Machinery, Third Edition, by Hamilton H. Mabie and Fred W. Ocvirk, published by John Wiley and Sons, which is incorporated by reference herein. The aforementioned design approach, commonly referred to as "dynamic" balancing, accounts only for the unbalance which is created by the mass centers of the pad and portions of the assembly not disposed concentric to the first axis. Dynamic balancing adds counterweight masses to the housing that are symmetrically positioned with respect to a radial plane of the second axis.

Dynamic balancing can create a machine that is balanced, that is, has acceptably low vibration levels, while the machine is running at free speed in an unloaded condition. However, once the machine is loaded, as a result of placing the pad in abrading engagement with a work surface, additional forces are introduced and the machine becomes unbalanced. This unbalance is detected by the operator in the form of vibration. This vibration is undesirable and in severe cases, may lead to vibration-induced injuries such as carpal tunnel syndrome and white finger.

An improved design approach shown in commonly assigned U.S. Pat. No. 6,206,771 (Lehman), which is incorporated by reference herein, and which is hereinafter referred to as Lehman, employs counterbalancing in such a manner as to minimize vibrations under actual working conditions. However, the counterbalancing disclosed in Lehman is only effective for predetermined operating conditions.

What is needed then is a convenient and cost-effective means of balancing an orbital abrading machine to minimize vibrations associated with a wider variety of abrading operations.

SUMMARY OF THE INVENTION

It is known that both orbital and random orbital abrading machines, which include for example, sanding, grinding, and buffing machines, may be counterbalanced in such a manner as to minimize vibrations under actual working conditions. Further, it is known to employ a counterbalancing system adapted to minimize vibration of an orbital abrading machine under predetermined operating conditions.

The present invention relates to an improved, orbital abrading machine, and more particularly to an improved random orbital buffer, which may be more readily counterbalanced to provide effective dampening of vibrations under a wider variety of actual working conditions. The present invention can include a variety of replaceable counterweight modules respectively configured for different set of operating conditions, for example, the use of different diameter buffing pads with an orbital buffer.

The present invention head portion for counterbalancing a random orbital machine includes a first element adapted for connection to a drive means for the machine and for connection to an abrasive pad assembly. The drive means is rotatable about a first axis of rotation and the abrasive pad assembly is rotatable about a second axis of rotation that is parallel to the first axis of rotation and lying within a plane common with the first axis. The head portion also includes a second element detachably connected to the first element. The first and second elements are configured to at least substantially counterbalance portions of the abrasive pad assembly not disposed concentrically of the first axis of rotation and forces to which the abrasive pad assembly is exposed during use as a result of the abrasive pad assembly engaging with a work surface.

A general object of the present invention is to provide an apparatus to facilitate the counterbalancing of an orbital abrading machine under a wide range of loaded conditions.

Another object of the present invention is to provide an apparatus having a multiplicity of readily installed counterbalancing elements, where each element is configured for a particular set of operating conditions such as size or type of abrading pad.

These and other objects, features and advantages of the present invention will become readily apparent to those having ordinary skill in the art upon a reading of the following detailed description of the invention in view of the drawings and claims.

BRIEF DESCRIPTION OF THE DRAWINGS

The nature and mode of operation of the present invention will now be more fully described in the following detailed description of the invention taken with the accompanying drawing Figures in which.

DETAILED DESCRIPTION OF THE INVENTION

At the outset, it should be appreciated that like drawing numbers on different drawing views identify substantially identical structural elements of the invention. While the present invention is described with respect to what is presently considered to be the preferred embodiments, it is understood that the invention is not limited to the disclosed embodiments.

Furthermore, it is understood that this invention is not limited to the particular methodology, materials and modifications described and as such may, of course, vary. It is also understood that the terminology used herein is for the purpose of describing particular embodiments only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
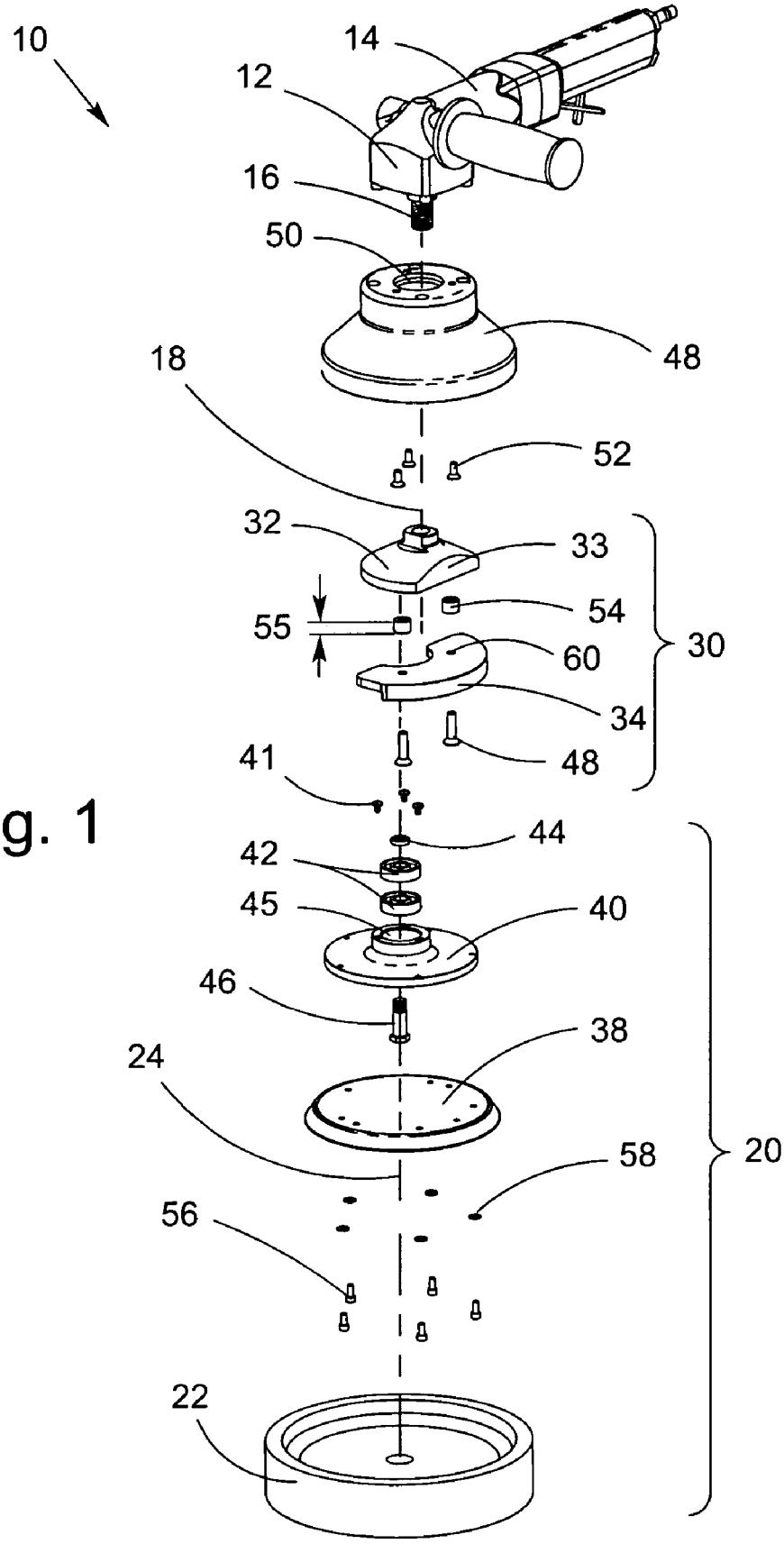
FIG. 1 is an exploded prospective view of a random orbital abrading machine embodying the present invention.

Reference is first made to FIG. 1, which is an exploded prospective view of a random orbital abrading machine 10 embodying the present invention. An orbital abrading machine is generally designated as 10 and shown as generally including a manually manipulated housing 12 and a motor 14 mounted within the housing and including or being suitably coupled to a threaded drive shaft 16 driven for rotation about a first axis of rotation 18. An abrasive pad assembly 20 includes an abrasive pad 22 and is connected to drive shaft 16 such that the pad is caused to orbit about the first axis 18.

Preferably machine 10 is in the form of a random orbital machine in which an abrasive pad assembly 20 includes an abrasive pad 22 supported by the remainder of abrasive pad assembly 20 for free rotational movement about a second axis 24, which is disposed parallel to and orbits about first axis 18. Motor 14 may be a pneumatically driven motor connected to a suitable supply of air under pressure.

Figure 2:
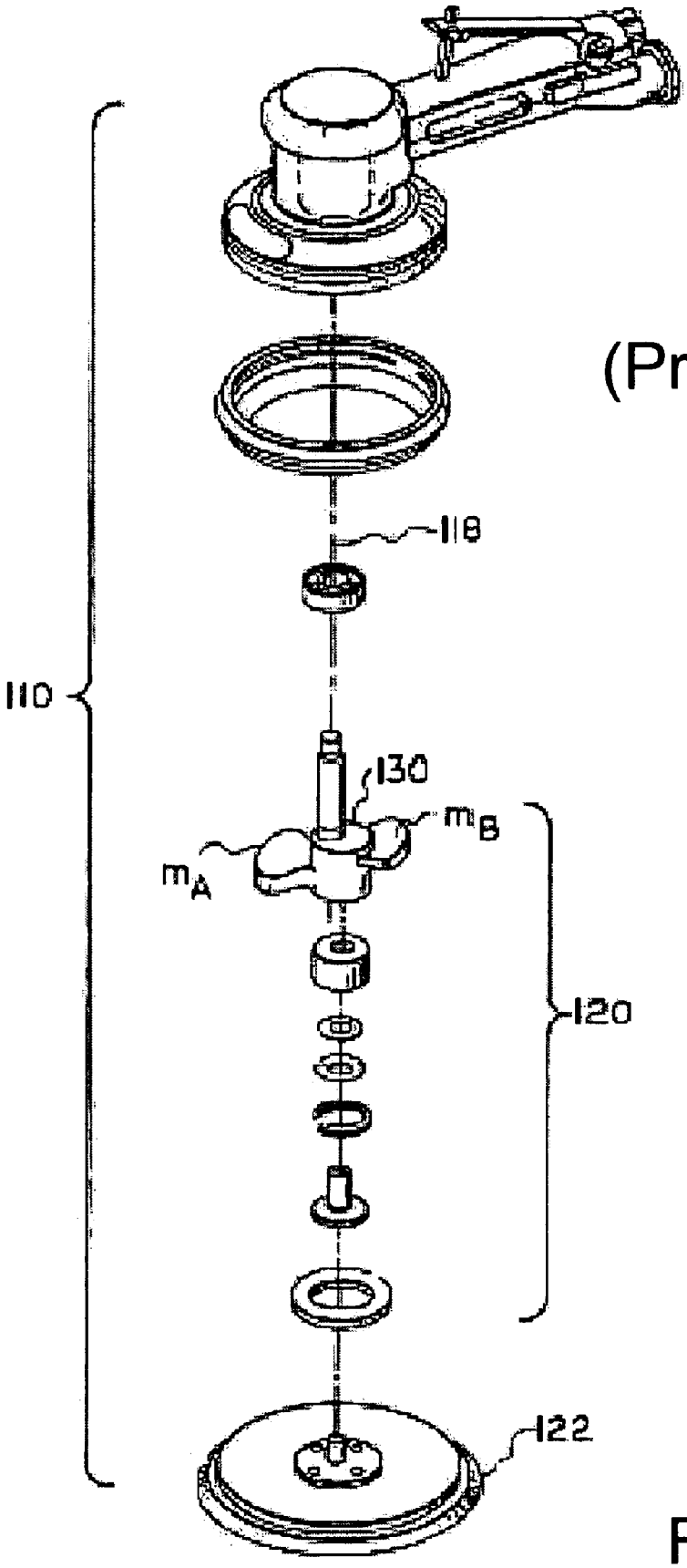
FIG. 2 is an exploded prospective view of a prior art random orbital abrading machine embodying a counterbalancing means for operation under a loaded condition.

FIG. 2 is an exploded prospective view of a prior art random orbital abrading machine embodying a counterbalancing means for operation under a loaded condition. FIG. 2 is a representation of FIG. 1 from Lehman. Lehman takes into consideration forces at work, during actual working conditions, which oftentimes result in a properly balanced machine becoming unbalanced to an unacceptable degree during use. These forces include the moment associated with masses not concentric with the first axis of rotation noted above, and forces to which an abrasive pad for the machine is exposed during use as a result of the abrasive pad engaging with a work surface, for example, sanding or buffing the surface. As a result of these considerations, Lehman provides a head portion 130 that balances the machine while the machine is subjected to predetermined working conditions, under which the machine is intended for use, so as to minimize vibrations to which an operator is exposed while actually using the machine for performing a given type of abrading operation.

The following should be viewed in light of FIGS. 1 and 2. In general terms, abrasive pad assembly 20 in FIG. 1 may be similar to assembly 120 in FIG. 2. Further, head portion 30 acts as a counterweight to balance machine 10 under load, much like head portion 130 balances machine 110. However, unlike the one-piece head portion 130 shown in FIG. 2, head portion 30 includes two elements, adapter 32 having a face 33, and interchangeable counterweight 34. Adapter 32 and interchangeable counterweight 34 are further described below.

Returning to FIG. 1, adapter 32 is mechanically coupled to or formed integrally with drive shaft 16. Abrasive pad assembly 20 includes interface pad 38, to which pad 22 is attached, interface pad mounting plate 40, fasteners 41, bearings 42, and bearing spacer 44. Pad 38 is connected to plate 40 by fasteners 56 in conjunction with washers 58. Mounting pad 40 includes a recess 45, sized to mount bearings 42. Bearings 42 serve in turn to support means for connecting pad 22 to bearing 42, such as may be defined by threaded interface pad mounting plate retaining shoulder bolt 46 passing through interface pad mounting pad 40, bearings 42 and bearing spacer 44. Bolt 46 is disposed for rotation concentrically about axis 24. Adapter 32 is formed with a threaded orifice, which is designated as 66 only in FIG. 7, to accept bolt 46. This orifice has an axis disposed coincident with second axis 24. Also shown in FIG. 1 are guard 48, having an opening 50 sized and configured to pass drive shaft 16, and fasteners 52 used to fasten guard 48 to housing 12. It is understood that guard 48 can take more than one shape and that such shape is not germane to the invention. In addition, fasteners 41, 52, and 56 and washers 58 can take any form known in the art, and that the type of fasteners 41, 52, or 56 or washers 58 used is not germane to the invention. It is further understood that, in general, other configurations of assembly 20 are possible and that such configurations are not germane to the invention. That is, the head portion 30 can be configured to counterbalance vibrational forces associated with any typical configuration of assembly 20. Spacers 54 with a thickness 55 are used to separate adapter 32 and counterweight 34.

Lehman noted that the dynamic balancing technique for orbital machines, described supra, did not take into account working loads, such as drag caused by bearing engagement of the abrading or buffing pad with a surface. Lehman further noted that is was necessary to consider the angular velocity of masses associated with the buffer in order to determine the values and positions required to be assumed by balancing masses in order to achieve balance under actual working conditions.

With certain orbital machines, such as sanders, the degree of unbalance, and thus vibration experienced by an operator under typical working conditions, is normally found to be within acceptable limits. However, for other orbital machines, such as for example, buffers, the degree of unbalance is typically found to be greater and may reach a level at which prolonged use of the machine may cause serious vibration induced injury to an operator.

Figure 3:
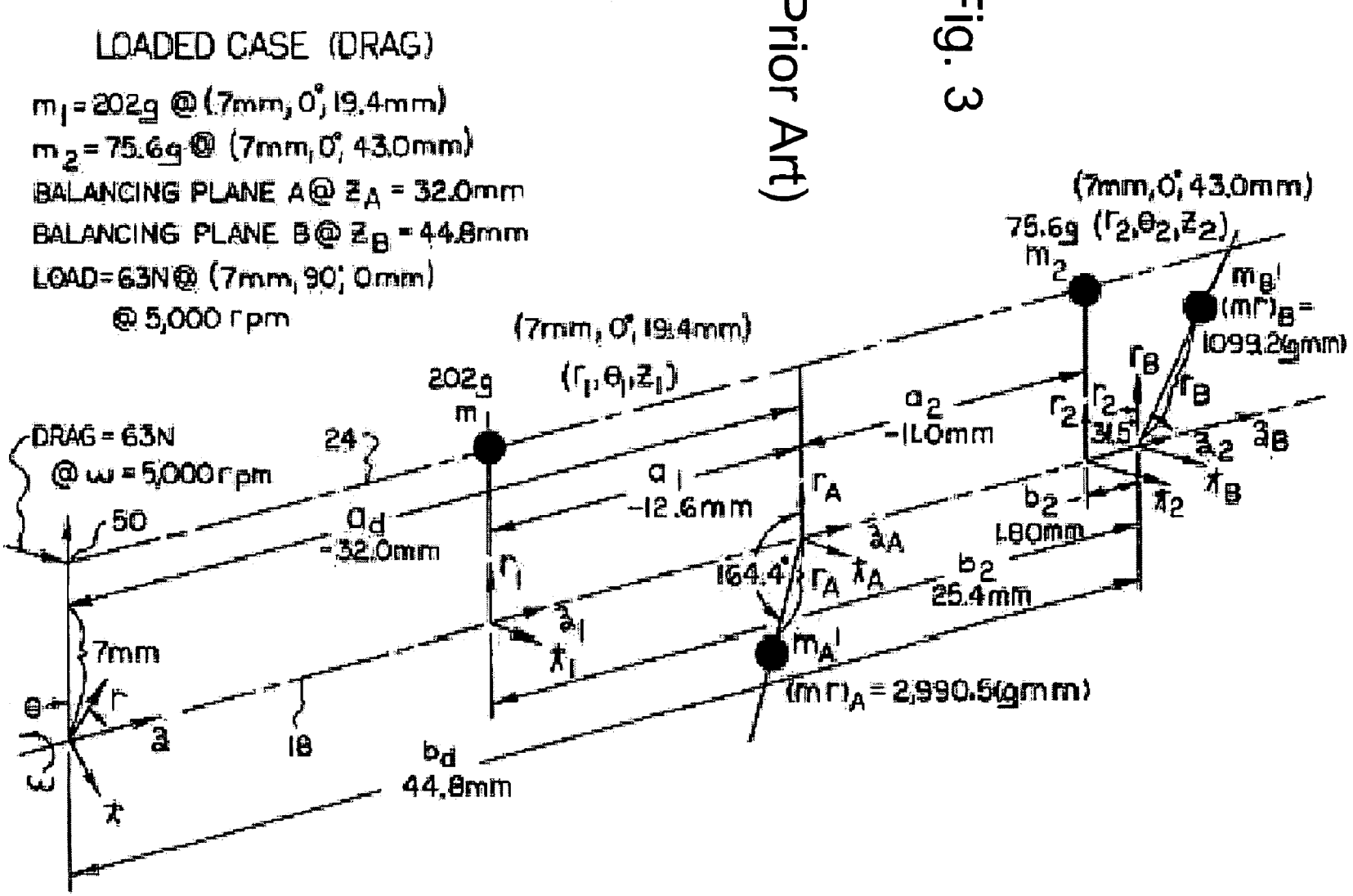
Fig. 3 (Prior Art)
FIG. 3 is a balance sketch illustrating a prior art mode of counterbalancing an orbital abrading machine for operation under a loaded condition.

FIG. 3 is a balance sketch illustrating a prior art mode of counterbalancing an orbital abrading machine for operation under a loaded condition. FIG. 3 is a representation of FIG. 3 from Lehman. FIG. 3 and TABULATION II (not shown) in Lehman illustrate the approach used in Lehman to determine counterweights for an orbital or random orbital machine, which is adapted to be balanced while subjected to predetermined working conditions under which the machine is intended for use. The counterweights are determined so as to minimize vibrations to which an operator is exposed, while actually using the machine for performing a given type of abrading operation.

The following should be considered in light of FIGS. 2 and 3. FIG. 3 and TABULATION II take into consideration torque applied to pad 122 in opposition to the driven rotation of assembly 120 about axis 118 under a predetermined working condition. The figure and tabulation also account for the angular velocity of masses associated with the assembly 120 ($m_1$ and $m_2$) and the 'unloaded' state counterweights ($m_A^1$ and $m_B^1$). As a result, the sizes and angular orientations of masses $m_A^1$ and $m_B^1$, relative to a plane, such as may be conveniently defined by a working surface of pad 122 to be presented for abrading engagement with a work surface (not shown), required to balance the sample machine under a predetermined working condition, differ from the size and orientation of masses $m_A^1$ and $m_B^1$ previously determined by Lehman to be required to balance such machine while in an unloaded condition, that is, dynamic balancing as described supra. The drag force lies within the previously mentioned reference plane, that is, the surface of pad 122 disposed in abrading engagement with the work surface, and passes through the center of pad 122 tangential to the orbital path of such center about axis 118. It is important to note that masses $m_A^1$ and $m_B^1$ in head portion 130 are not symmetrically located with respect to the second axis of rotation. That is, if $m_A^1$ is positioned on a plane parallel to the second axis of rotation and intersecting the second axis of rotation, $m_B^1$ will not be positioned on this plane. This asymmetrical configuration is illustrated in FIG. 5*b* (not shown) from Lehman. That is, $m_A^1$ and $m_B^1$ and the second axis are not collinear, unlike in the dynamic approach noted supra and illustrated in FIG. 5*a* (not shown) in Lehman. Hereinafter, the above-described asymmetrical relationship of $m_A^1$ and $m_B^1$ is referred to as the offset of $m_A^1$ and $m_B^1$.

The counterweight masses $m_A^1$ and $m_B^1$, the mass and location of which have been determined as described in Lehman, are integral to head portion 130. Thus, a particular head portion 130 cannot be adapted to changing conditions, and is therefore, only effective for a particular set of operating conditions. As a result, if operating conditions are outside the conditions for which a particular head portion 130 has been configured, the head portion must be replaced with another head portion suitable for the new set of conditions. For example, switching from an 8-inch buffing pad to an 11-inch buffing pad could alter operating conditions sufficiently to create undesirable vibrational forces in an orbital machine. Unfortunately, to replace head portion 130, the head portion 130 must be disconnected from the drive shaft, which may be a burdensome task in the field.

The following should be considered in light of FIGS. 1 and 3. To provide counterbalancing responsive to a wider set of operating conditions, the present invention uses head portion 30 including adapter 32, and interchangeable counterweight 34. The methodology shown in FIG. 3 and TABULATION II is used to determine the mass, shape, and relative positions of adapter 32 and counterweight 34 for a baseline set of conditions. However, as noted above, when actual operating conditions vary too widely from the baseline conditions, adapter 32 and counterweight 34 will provide diminished vibration reduction. Therefore, for a set of operating conditions outside the baseline conditions, the mass and position of adapter 32 are held constant (so that adapter 32 can be left connected to the drive shaft) and the configuration of counterweight 34 is modified to provide the necessary counterbalancing. Thus, while keeping adapter 32 as a constant with respect to counterbalancing calculations, a multiplicity of counterweights 34 are configured to provide the counterbalancing needed for a corresponding multiplicity of working conditions. For example, one counterweight 34 can be configured for an 8-inch buffing pad and another counterweight 34 can be configured for an 11-inch buffing pad.

Figure 4:
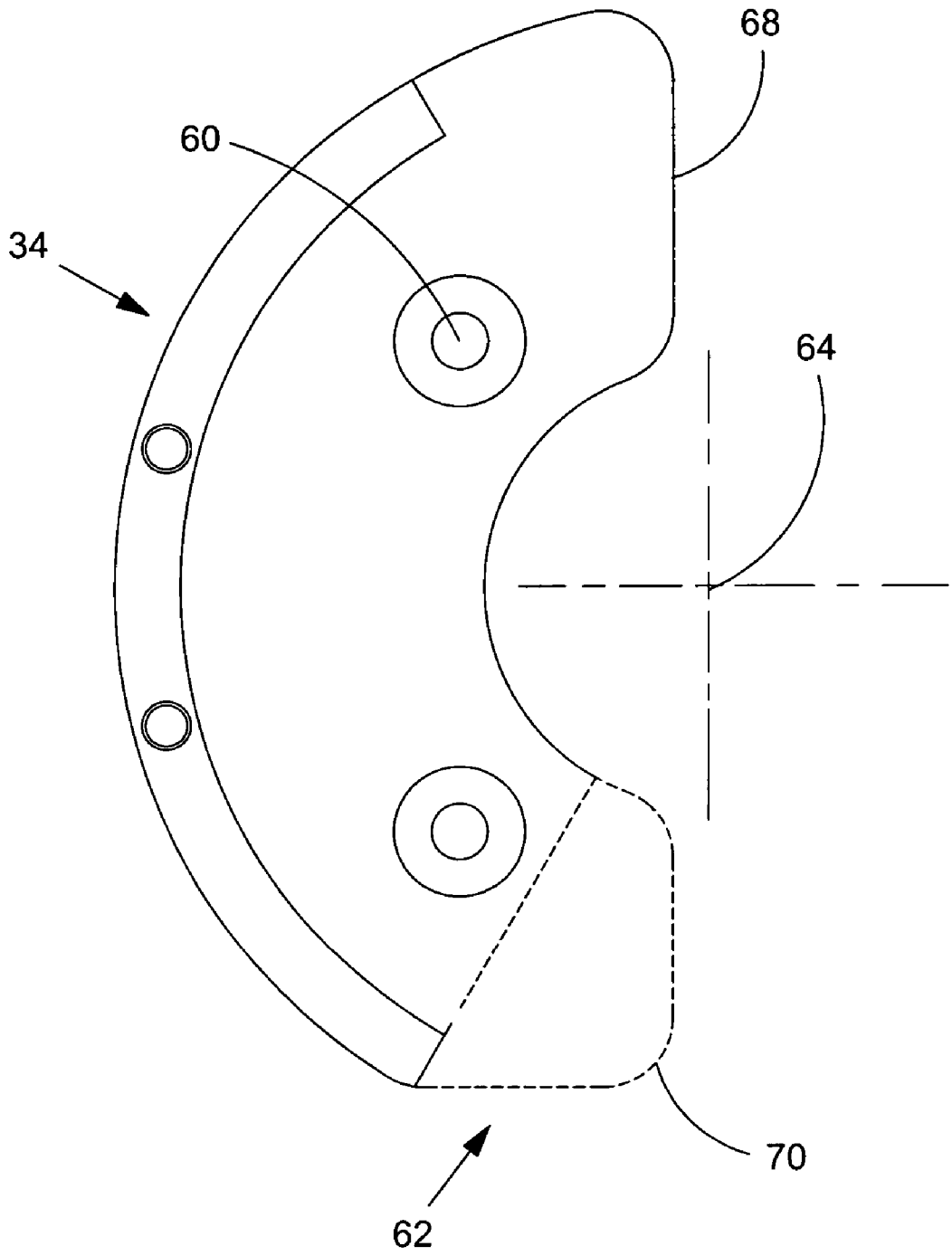
FIG. 4 is a plan view of the counterweight shown in FIG. 1.

FIG. 4 is a plan view of the counterweight 34 shown in FIG. 1. The following should be considered in light of FIGS. 1 through 4. The offset of $m_A^1$ and $m_B^1$ is implemented in head portion 30. For purposes of discussion, $m_A^1$ is assumed to be part of adapter 32 and $m_B^1$ is assumed to be part of counterweight 34. However, it should be understood that other configurations of $m_A^1$, $m_B^1$, adapter 32, and counterweight 34 are possible, and that such configurations are within the spirit and scope of the invention as claimed. In one embodiment, adapter 32 is formed having the substantially circular perimeter and face 33 as shown in FIG. 1. In this embodiment, cross-sections of adapter 32 taken parallel to face 33 are uniform. Then, counterweight 34 is formed such that $m_B^1$ is asymmetrical with respect to $m_A^1$ in the abovementioned reference plane.

One approach for obtaining the above asymmetry for $m_B^1$ is shown in FIG. 4, in which counterweight 34 is formed with an initial planar symmetry with respect to a point 64. Then, section 62 is removed, resulting in an asymmetrical shape for counterweight 34 with respect to point 64. Thus, when counterweight 34 is connected to adapter 32, the resulting head portion 30 has the required offset of $m_A^1$ and $m_B^1$. The amount of asymmetry in counterweight 34 can be controlled by the size of section 62 removed from the counterweight. It should be readily apparent to one skilled in the art that other combinations of symmetry for adapter 32 and counterweight 34 are possible and are within the spirit and scope of the invention as claimed. For example, adapter 32 could be formed with non-uniform cross-sections with respect to face 33. Also, the asymmetry of counterweight 34 could be provided by varying the density, rather than the shape of counterweight 34. For example, looking at FIG. 4, section 62 could be left on counterweight 34 and then beginning at edge 68 and moving toward edge 70, counterweight 34 could be formed with progressively increasing or decreasing density.

Figure 5:
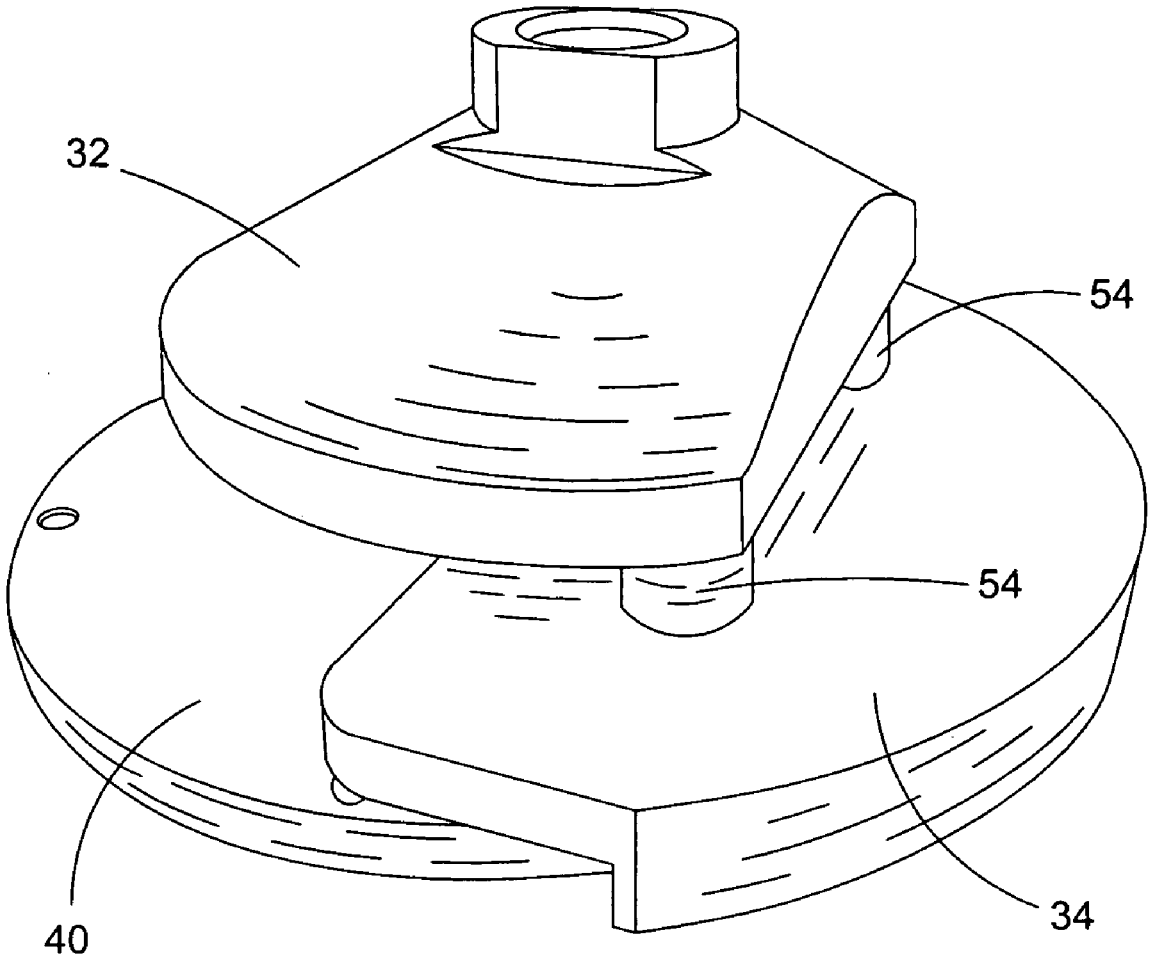
FIG. 5 is a perspective view showing further detail of the head portion and portions of the assembly shown in FIG. 1.

FIG. 5 is a perspective view showing further detail of the head portion 30 and portions of the assembly 20 shown in FIG. 1.

Figure 6:
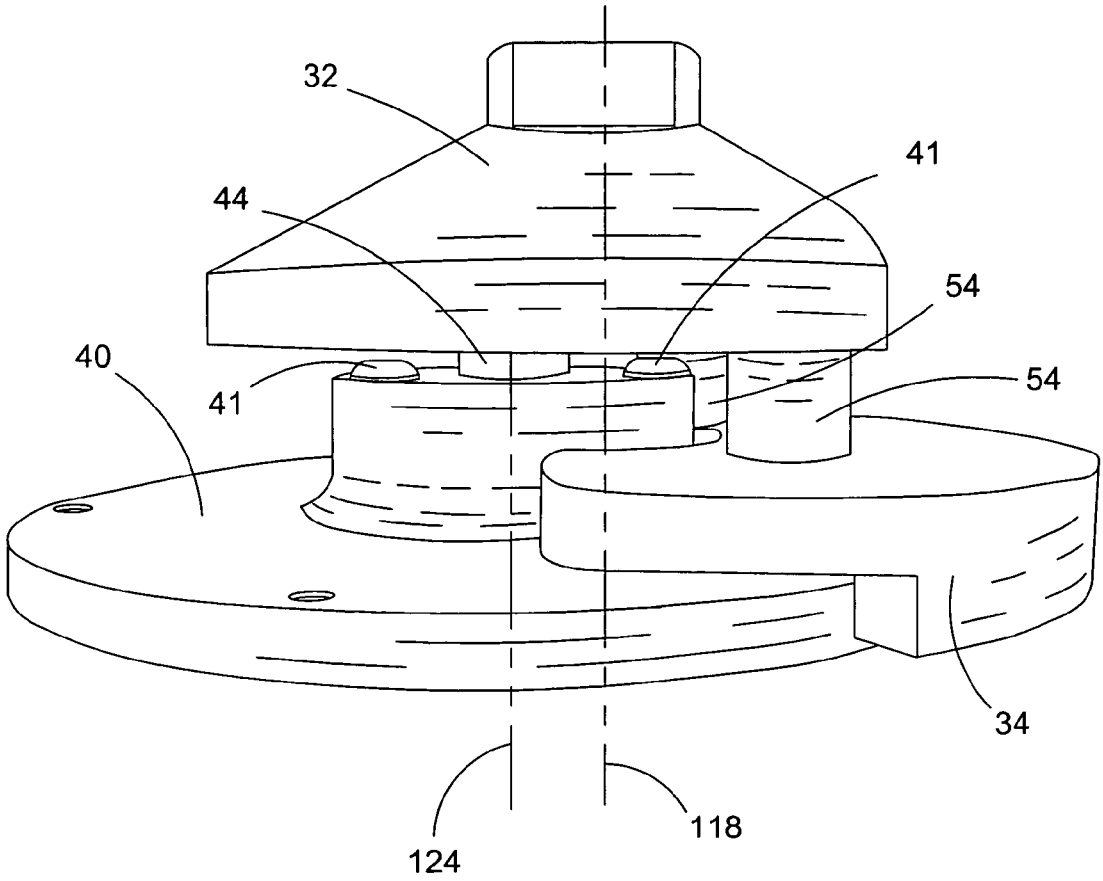
FIG. 6 is a side view of the head portion and portions of the assembly shown in FIG. 5; and, FIG. 7 is a partial cross-sectional view of the random orbital abrading machine of FIG. 1.

FIG. 6 is a side view of the head portion 30 and portions of the assembly 20 shown in FIG. 5. The following should be considered in light of FIGS. 5 and 6. Counterweight 34 is attached to adapter 32 with bolts 48 that pass through holes 60 in counterweight 34 and thread into adapter 32. Spacers 54 separate adapter 32 and counterweight 34. Thus, bolt 46 can be removed from adapter 32 and plate 28 removed from bolt 46 to expose bolts 48. Then, bolts 48 can be removed, releasing counterweight 34. It should be readily apparent to one skilled in the art that other means known in the art can be used to attach counterweight 34 to adapter 32, and such means are within the spirit and scope of the invention as claimed. For example, combinations of pins, holes, interlocking features, clips, or threaded fasteners could be used.

Thickness 55 of spacers 54 determines the separation between adapter 32 and counterweight 34. This separation can affect the counterbalancing effects of head portion 30. Although such affects are not described herein, it should be understood that the calculation of such effects, and the modification of head portion 30 in response to such calculations, is within the spirit and scope of the invention as claimed.

Figure 7:
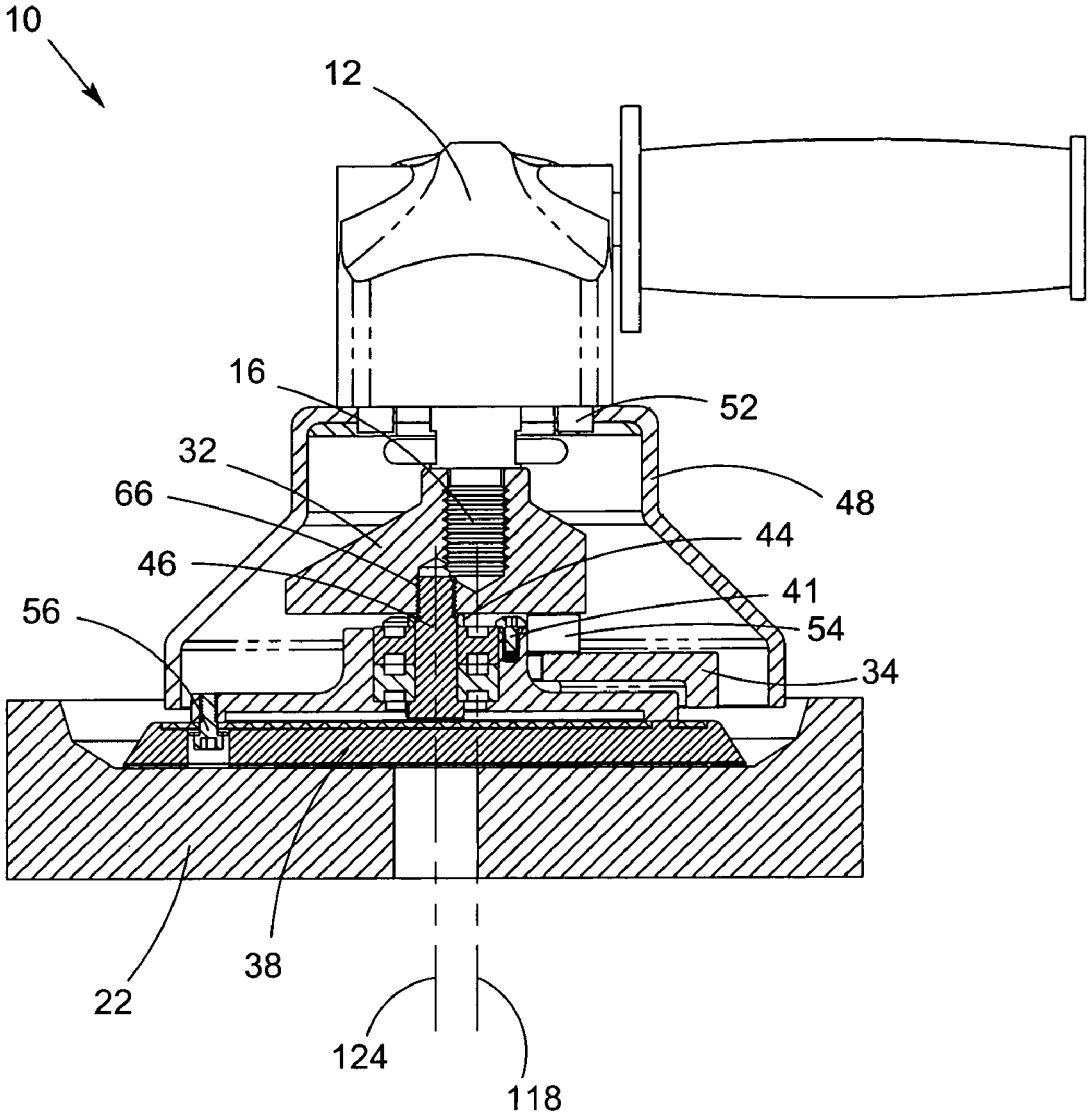

FIG. 7 is a partial cross-sectional view of the random orbital abrading machine 10 of FIG. 1. FIG. 7 is provided to illustrate machine 10 in the assembled configuration. FIG. 7 shows the connection of drive shaft 16 with adapter 32 and the connection of bolt 46 with threaded orifice 66 in adapter 32. Also, the offset between axis 118 and 124 is clearly shown.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A head portion for counterbalancing a random orbital machine, the head portion comprising:

a first element adapted for connection to a drive means for said machine and for connection to an abrasive pad assembly, said drive means rotatable about a first axis of rotation and said abrasive pad assembly rotatable about a second axis of rotation disposed parallel to said first axis of rotation and lying within a common plane therewith; and, a second element detachably connected to said first element; and, wherein said first and second elements are configured to at least substantially counterbalance:

portions of said abrasive pad assembly not disposed concentrically about said first axis of rotation; and, forces to which said abrasive pad assembly is subjected to during use as a result of said abrasive pad assembly engaging with a work surface.

2. The head portion as recited in claim 1 wherein said first and second elements further comprise first and second centers of mass, respectively; and, wherein said first and second centers of mass are asymmetrically disposed with respect to a radial plane of said second axis of rotation.

3. The head portion as recited in claim 2 wherein said abrasive pad assembly is selected from a plurality of abrasive pad assemblies having different configurations, and, wherein said second element is selected from a plurality of second elements, each second element in said plurality of second elements configured, in combination with said first element, to at least substantially counterbalance, for a respective abrasive pad assembly in said plurality of abrasive pad assemblies:

portions of said respective abrasive pad assembly not disposed concentrically of said first axis of rotation; and, forces to which said respective abrasive pad assembly is exposed during use as a result of said respective abrasive pad engaging with a work surface.

4. The head portion as recited in claim 3 wherein said plurality of abrasive pad assemblies further comprises a plurality of buffing pads having different diameters.

5. The head portion as recited in claim 3 wherein said plurality of abrasive pad assemblies further comprises a plurality of abrasive pads having different coefficients of friction.

6. The head portion as recited in claim 3 further comprising:

means to mechanically fasten said second element to said first element.

7. The head portion as recited in claim 8 wherein said mechanical fastening means further comprises at least one threaded fastener securing said second element with respect to said first element.

8. The head portion as recited in claim 7 wherein said mechanical fastening means further comprises first and second spacers disposed interspatially of said first and second elements; and, wherein said at least one threaded fastener further comprises first and second threaded fasteners passing through said first and second spacers, respectively.

9. The head portion as recited in claim 8 wherein said first and second spacers have a thickness measured substantially parallel to said second axis of rotation, said first and second spacers are selected from a plurality of corresponding first and second spacers, and each said corresponding first and second spacer in said plurality of corresponding first and second spacers has a different said thickness.

10. The head portion as recited in claim 3 wherein said drive means further comprises a drive shaft and said machine further comprises a housing and a guard assembly adapted for mechanical connection to said housing and having an opening adapted to pass said drive shaft; and, wherein said first element defines a mounting recess and supports within said mounting recess a bearing means defining said second axis of rotation, and said abrasive pad assembly further comprises means for connecting said abrasive pad assembly to said bearing means.

11. The head portion as recited in claim 10 wherein said recess in said first element further comprises a threaded orifice aligned with said second axis of rotation, said bearing means further comprises, disposed concentrically of said second axis of rotation, first and second bearing races and a bearing spacer disposed interspatially of said first and second bearing races and said first element, and said abrasive pad assembly further comprises:

an interface pad mounting plate disposed concentrically of second axis of rotation and defining a hole aligned with said second axis of rotation;

an interface pad mounting plate retaining shoulder bolt aligned with said second axis of rotation, passing through said hole in interface pad mounting plate, said first and second bearing races, and said bearing spacer, and adapted to matingly engage said threaded orifice in said recess;

an interface pad operatively arranged to connect to said interface pad mounting plate; and, a buffing pad operatively arranged to attach to said interface pad.

12. A random orbital machine with counterbalancing, the machine comprising:

a drive shaft for said machine rotatable about a first axis of rotation;

a first head portion element adapted to connect to said drive shaft and adapted to provide a rotation means parallel to said first axis of rotation and lying within a common plane therewith;

an abrasive pad assembly adapted for connection to said rotation means and comprising a buffing pad; and, a second head portion element detachably connected to said first element; and, wherein said first and second elements are configured to at least substantially counterbalance:

portions of said abrasive pad assembly not disposed concentrically of said first axis of rotation; and, forces to which said buffer pad is exposed during use as a result of said buffing pad engaging with a work surface.

13. A method for counterbalancing a random orbital machine having an abrasive pad assembly orbiting about a first axis of rotation, rotating about a second axis of rotation parallel to said first axis of rotation, and engaging a work surface, comprising the steps of:

determining a mass for portions of said abrasive pad assembly non-concentrically disposed about said first axis and an angular velocity for said mass;

determining a force associated with said engagement; and, responsive to determining said mass, said angular velocity, and said force:

selecting a mass and position for a first counterbalancing mass disposed in a first counterbalancing element rotating about said second axis; and selecting, for a second counterbalancing mass disposed in a second counterbalancing element, detachably connected to said first counterbalancing element, a mass and, in a plane parallel to said work surface, an asymmetrical position with respect to said first counterbalancing mass; and, wherein said first and second counterbalancing masses are selected to at least substantially counterbalance said mass and said force.

* * * * *